United States Patent [19]

Vakil

[11] 4,393,661

[45] Jul. 19, 1983

[54] MEANS AND METHOD FOR REGULATING FLOWRATE IN A VAPOR COMPRESSION CYCLE DEVICE

[75] Inventor: Himanshu B. Vakil, Schenectady, N.Y.

[73] Assignee: General Electric Company, Schenectady, N.Y.

[21] Appl. No.: 329,493

[22] Filed: Dec. 10, 1981

[51] Int. Cl.[3] ..... F25B 41/00

[52] U.S. Cl. ..... 62/113; 62/114; 62/504; 62/511; 62/513; 62/527

[58] Field of Search ..... 62/114, 504, 511, 527, 62/174, 513, 113

[56] References Cited

U.S. PATENT DOCUMENTS

| | | | |
|---|---|---|---|
| 2,404,010 | 7/1946 | Urban | 62/511 |
| 3,044,273 | 7/1962 | Lower et al. | 62/511 |
| 3,145,545 | 8/1964 | Jaeger | 62/513 |
| 3,150,502 | 9/1964 | Tucker | 62/511 |
| 3,162,021 | 12/1964 | Brody | 62/511 |
| 3,285,030 | 11/1966 | Coyne | 62/511 |
| 3,638,447 | 2/1972 | Abe | 62/511 |
| 4,306,421 | 12/1981 | Gucwa, Jr. et al. | 62/511 |

*Primary Examiner*—Ronald C. Capossela

*Attorney, Agent, or Firm*—Richard J. Traverso; James C. Davis, Jr.; James Magee

[57] ABSTRACT

A vapor compression cycle device is provided which incorporates a first expansion device, a second expansion device with inlet positioned upstream from said first expansion device and means to transfer heat from the working fluid liquid flowing through said first expansion device to the expanded working fluid flowing through said second expansion device so as to maximize efficiency benefits due to flowrate regulation thus permitting the working fluid flowrate to depend on the level of liquid working fluid accumulated at the condenser.

9 Claims, 1 Drawing Figure

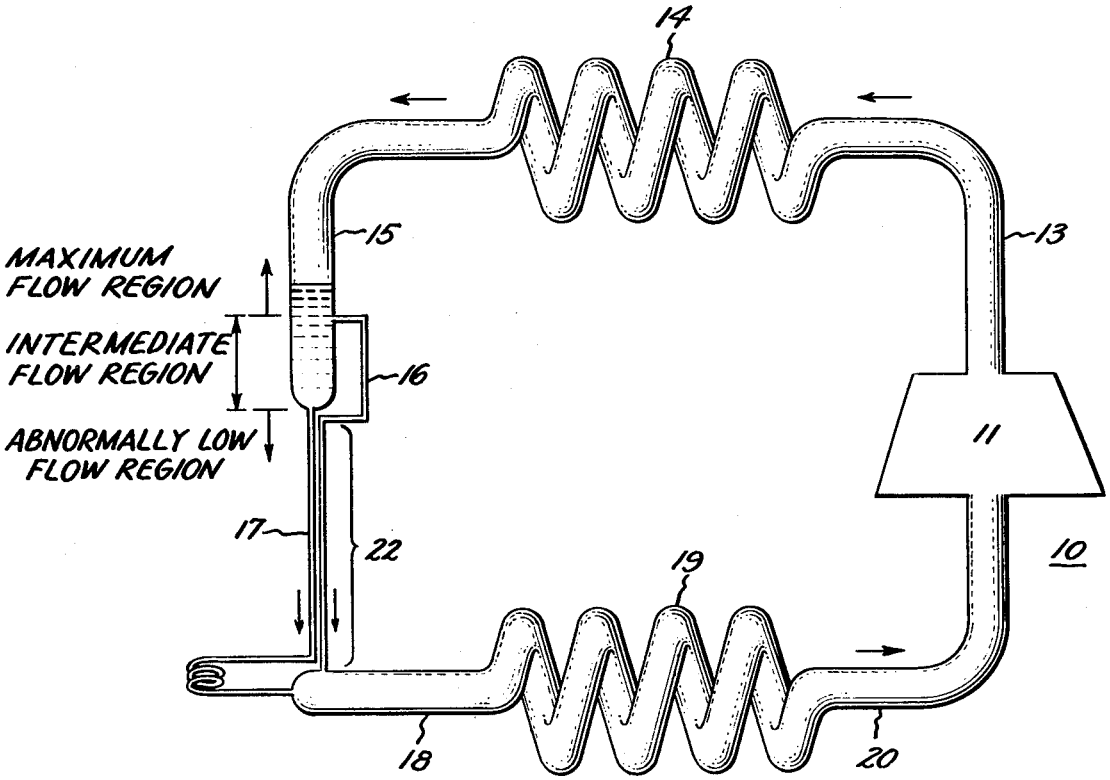
14
15
13
MAXIMUM FLOW REGION
INTERMEDIATE FLOW REGION
16
ABNORMALLY LOW FLOW REGION
11
17
22
10
19
18
20

MEANS AND METHOD FOR REGULATING FLOWRATE IN A VAPOR COMPRESSION CYCLE DEVICE

Reference is made to copending application U.S. Ser. No. 323,851 filed Nov. 23, 1981. Two Capillary Vapor Compression Cycle Device by H. Vakil, assigned to the same assignee as the present invention.

This invention relates to a vapor compression cycle device and to a method for regulating working fluid flow rate and, more particularly, to such a device incorporating two expansion devices or capillaries in heat exchange relationship, a first main capillary connected at the termination of the condenser outlet tube and a second capillary connected upstream from the main capillary so that the first capillary passes liquid working fluid and the second capillary can pass either liquid or vapor working fluid depending on the volume of liquid which has accumulated at the condensor outlet. This arrangement serves to regulate working fluid flow in two ways. First, when the volume of liquid accumulated becomes large the level of said liquid rises above the inlet of the second capillary at which time the second capillary begins to pass liquid instead of vapor and consequently the mass flow rate of working fluid passing through the second capillary increases and the level of liquid at the condensor outlet is regulated. Second, when any liquid working fluid passes through the second capillary it is cooled. Since the capillaries are in heat exchange relationship with each other the first or main capillary is cooled below its typical operating temperatures or subcooled. This subcooling of the main capillary results in an increase in main capillary flowrate.

In a conventional vapor compression cycle device such as a heat pump a working fluid is circulated through an expansion device into an evaporating heat exchanger where the working fluid absorbs heat. The heat vaporizes the working fluid liquid, and the resulting vapor is then circulated by a suitable compressor through a condensing heat exchanger where the vapor condenses into a liquid as heat is given off. The cycle is then repeated and the working fluid is recirculated through the system.

Various U.S. patents have described means and methods for modulating the capacity of vapor compression cycle devices. Among these are U.S. Pat. Nos. 2,807,943, 2,942,725, 4,003,215, 4,179,898, 4,217,760, 4,218,890, 4,283,919, 4,290,272. The above patents generally include means to modulate the capacity of the device to absorb and deliver heat, herein referred to as device thermal capacity, in response to variable heating and cooling demands in order to maximize efficiency. This is usually accomplished by regulating the amount of multicomponent working fluid allowed to flow from a first accumulator through an evaporator to a second accumulator located at a compressor inlet. This results in a change in the molar flow rate through the compressor and thus a change in device thermal capacity.

For the efficient operation of a vapor compression cycle device, it is necessary to ensure that the expansion device, usually in the form of a capillary, is supplied with working fluid liquid mostly free of vapor and at the same time to ensure that there is not an excess of liquid causing it to back-up into the condenser. In either of the above circumstances the vapor compression cycle device suffers a loss in efficiency.

During one specific set of conditions which occurs for example during start-up of the vapor compression cycle device and during periods of high cooling demand, the evaporator is warm and the compressor pumps large amounts of working fluid to the condenser. At a given condensor pressure and in the absence of subcooling of the capillary flow, the flowrate through a single capillary is fixed. Consequently, the capillary is unable to pass all of the condensed liquid to the evaporator and thus the working fluid accumulates in the condenser as a liquid. This has a detrimental effect on both the condenser which is now flooded and the evaporator which is now starved.

At other times, especially towards the end of a cycle, the evaporator temperature drops as does the flow of compressed working fluid. As a result, the liquid in the condenser drains and eventually vapor is allowed to pass through the expansion device or capillary. This leads to a loss of efficiency since this vapor performs no useful cooling.

These two extreme requirements force a compromise in the selection of a capillary size which corresponds to the average flowrate during average conditions so as to avoid having either a surplus or a deficit of liquid working fluid at the inlet of the expansion device. Unfortunately, this balance can be achieved for only one set of operating conditions. In typical operation of a vapor compression device cycle, the capillary flow is usually lower than needed during the early part of the cycle and higher than desirable during the latter part of the cycle.

The ability to regulate the flowrate through the expansion device would improve the device efficiency by adapting to various operating conditions without incurring the disadvantages mentioned above.

An object of this invention is to provide a simple, maintenance free, inexpensive solution to the problem of optimizing the flow characteristics of an expansion in a vapor compression device.

A further object of this invention is to provide means for maintaining a proper accumulation of liquid at the capillary inlet in vapor compression devices that incorporate capacity modulation.

The present invention discloses a method for regulating the working fluid flowrate in a vapor compression cycle device which comprises compressing a working fluid vapor in a compressor condensing working fluid vapor in a condensing heat exchanger, passing a portion of the working fluid from said condensing heat exchanger through a first expansion device positioned so as to pass working fluid from the lower most portion of the output of said condensing heat exchanger or its termination, passing a portion of the working fluid from said condensing heat exchanger through a second expansion device in heat exchange relationship with said first expansion device, said second expansion device positioned so as to pass working fluid from a region of the condensing heat exchanger output which is upstream or higher than the inlet to said first expansion device, passing working fluid from said expansion devices to an evaporating heat exchanger or to an evaporating heat exchanger and associated inlet tube of said compressor, evaporating the working fluid in the evaporative heat exchanger, and finally compressing the working fluid vapor for recirculation.

The present invention also discloses a vapor compression cycle device comprising a closed working fluid circuit said closed circuit comprising a compressor, a condenser, a first expansion device having an inlet at the termination or lower most portion of the outlet from said condenser, an evaporator connected to the outlet of said first expansion device, the outlet of said evaporator connected to said compressor, a second expansion device, having an inlet positioned upstream from said inlet of said first expansion device and an outlet connected intermediate the inlet of said evaporator and said compressor and means to transfer heat from the working fluid liquid flowing through said first expansion device to the expanded working fluid flowing through said second expansion device.

The amount of working fluid flowing through a capillary for a given inlet pressure is affected very markedly by both the temperature of entering liquid working fluid and the fraction of the fluid entering as vapor, the rest being saturated liquid. Lowering the temperature of the saturated liquid entering the capillary, also known as increasing the subcooling, will result in an increase in the mass flow rate through the capillary. Increasing the liquid fraction of working fluid entering the capillary also causes an increase in mass flow rate. Even a small fraction of the total flow entering as vapor greatly reduces the total flowrate.

The dependence of flowrate on temperature derives from the fact that the critical mass flow for which the outlet of a capillary becomes 'choked' is highly sensitive to the enthalpy of the fluid at the outlet, which in the case of a thermally isolated capillary is roughly the same as the enthalpy of the fluid at the inlet. Thus a large decrease (or increase) in flowrate of saturated liquid through a capillary can be obtained by increasing (or decreasing) the exit enthalpy of the capillary fluid by the addition (or withdrawal) of heat from the capillary.

The present invention exploits this phenomenon by permitting a significant exchange of heat between the fluid flowing in a first or main capillary and the fluid flowing in a second or trim capillary in a manner which amplifies the level control action of the second capillary and at the same time, by utilizing this amplification via temperature dependence, reduces the amount of vapor flow required to bring about a reduction in total flow.

The operation of this device during a typical on/off cycle in a refrigerator is described below.

The present invention uses two separate capillaries connecting the condenser outlet to the evaporator inlet. In some refrigerator configurations a molecular sieve dryer can preceed the capillaries. According to the invention, the condenser output tube has one capillary attached to the bottom of it as is the current practice. In addition to this capillary, there is another capillary joined to the condenser tubing slightly higher or upstream from, and in heat exchange relationship with the first. A typical distance between capillary inlets may be ½ inch to 1 inch. The capillaries may both terminate at the evaporator inlet or one may terminate downstream partway through the evaporator or at the compressor inlet.

In the region where the two capillaries are in heat exchange relationship, the trim capillary flow may be countercurrent to the main flow or cocurrent. Both variations achieve the desired end result but with some differences in the dynamic behavior. The outlet of the main capillary is connected to the inlet of the evaporator with the trim capillary outlet connected either to the same location, to the suction line, or in some cases to the line providing liquid injection to the compressor. When properly designed to provide for total evaporation of the trim flow, the second option is the preferred one.

The main capillary is sized to give the desired minimum flowrate at the end of the cycle without any cooling from the trim capillary. The trim capillary is sized such that when the liquid working fluid level rises above the inlet to the trim capillary, for example, during the early part of the on-cycle, the flow through the trim capillary plus the increase in main capillary flowrate, due to subcooling of the main capillary by the trim capillary, regulates the liquid level at the condenser output. The moment this higher than normal flow causes the liquid level to fall below the inlet of the trim capillary, its throughput decreases rapidly as more vapor enters it. The throughput of the main capillary also decreases as a consequence of the reduced cooling by the trim capillary, and the system operates with the lower flowrate suitable for the mid and late part of the cycle. The two capillaries together serve as a type of level control by adjusting the flowrate according to whether the trim capillary receives vapor or liquid. Over typical operating inlet and outlet pressures, the system has three different flowrate regions:

1. A maximum flowrate region occurring when both capillaries are flooded with liquid working fluid and the main capillary is subcooled to a maximum extent by the trim capillary.

2. A minimum flowrate region occurring when the trim capillary is substantially devoid of liquid, there is no cooling of the main capillary, and the main capillary receives part vapor.

3. A variable flowrate range from the maximum flowrate down to the design minimum flowrate with flowrate decreasing steadily with a gradual reduction in the cooling performed by the trim capillary as liquid level drops and more vapor enters the trim capillary while the main capillary inlet is flooded.

In typical conditions during maximum flow both capillaries are passing liquid. The temperature of the trim capillary flow falls commensurate with the local pressure, which is decreasing, in accordance with the thermodynamic relationship of vapor/liquid equilibrium. The portion of the trim capillary near the outlet is very cold, about −26° C. for a typical refrigerator application. The inlet portion of both capillaries is quite warm, about 43° C. By placing the colder part of the trim capillary in heat exchange with the warmer segment of the main capillary, the present invention accomplishes cooling of the main capillary liquid and heating of the trim capillary. This results in an increased main capillary flow and an evaporation of the trim capillary flow. The evaporation of the trim capillary is thus used as a control valve to manipulate the main capillary flow.

In some applications, e.g. household refrigerators, the main capillary is placed in heat exchange with the compressor suction line and undergoes some cooling. However, in contrast to the present invention, there is no mechanism for utilizing this cooling for the purpose of controlling the liquid accumulation at the capillary inlet. In fact, the dynamics of the heat exchange are in a direction opposite to that required for regulation. For example, when the capillary flowrate is higher than desirable, there is a spilling of excess liquid out of the evaporator into the suction line which leads to further evaporative cooling of the capillary. The net result is a tendency to further increase the capillary flowrate precisely when a reduction would be desirable. The reverse is true when the capillary flowrate is lower than desired leading to a reduction in cooling performed by the suction line and, consequently, a further reduction in the flowrate.

To apply the present invention to devices in which there is already heat exchange between the main capillary and the suction line, the trim capillary may be placed in heat exchange relationship with the main capillary at a location before the suction line at the warmest section of the main capillary or it may be placed in parallel heat exchange relationship with both the main capillary and the suction line.

The flow from the trim capillary may also be routed directly to the suction line upstream from the portion of the suction line in heat exchange with the main capillary thereby accomplishing the main capillary cooling.

In the absence of any heat exchange between the compressor inlet or suction line and the main capillary, it should be possible to select the trim capillary size so as to allow a total evaporation and superheating of the trim flow under the maximum flow conditions.

The present invention may be used in a single or multicomponent refrigerant vapor compression device regardless of whether capacity modulation is used. It can have a major impact on the transient performance of the device and on its sensitivity to the refrigerant charge and to the capillary conductance.

The various working fluids that can be employed are well known in the art. Single or multicomponent working fluids may be used. Preferred are fluorocarbon working fluids for example dichlorodifluoromethane and monochlorodifluoromethane. Examples of such fluoro-carbon working fluids can be selected from those described in U.S. Pat. No. 4,003,215 which is herein incorporated by reference.

The present invention may also be used to control the flowrate in devices incorporating capacity modulation. When the modulation is achieved, for example, either by ejecting the liquid from the high pressure accumulator or by taking up the vapor from the condenser, the liquid inventory upstream of the capillary is significantly altered. It is desirable, therefore, to increase the flow through the capillary temporarily during an increase in capacity and to reduce it during a decrease.

A more thorough understanding of the present invention may be obtained by reference to the accompanying drawing wherein:

The FIGURE is a schematic illustration of a vapor compression cycle device constructed in accordance with an embodiment of the present invention;

In the FIGURE there is shown a vapor compression cycle device 10 in accordance with the present invention. Device 10 has a compressor 11 for the working fluid. Tube 13 connects compressor 11 to the inlet side of condensing heat exchange 14. Tube 15 connects the outlet side of condensing heat exchanger 14 first to a trim capillary 16 then to the main capillary 17. Said capillaries are in heat exchange relationship in region 22. Tube 18 connects the outlet of both capillaries to an evaporating heat exchanger 19. A tube 20 connects the outlet side of exchanger 19 to compressor 11. Thus a closed system is provided containing a working fluid that flows cyclicly through the entire system.

The condensor outlet tube 15 terminates in a main capillary 17. A second trim capillary 16 is connected to the condensor outlet tube 15 upstream from its termination. The working fluid flowrate will vary depending on the amount of working fluid if any which has accumulated as a liquid in the condensor outlet tube. The maximum working fluid flowrate occurs when both the main and trim capillaries are passing liquid and no vapor and the temperature of the capillaries is relatively low. As the liquid level drops below the trim capillary inlet on the condensor outlet tube the trim capillary begins to pass vapor which results in a reduction in the cooling of the main capillary and a decrease in mass flowrate through both the capillaries. The trim capillary flowrate is reduced because of an increase in the inlet vapor fraction and the main capillary flowrate is reduced because of a decrease in the subcooling performed by the trim capillary.

The trim capillary can be positioned and sized so as to obtain a maximum mass flowrate which corresponds to the maximum transient device performance anticipated for the particular application and to optimize efficiency.

The above-described embodiments are intended to be exempletive only and not limiting, and it will be appreciated from the foregoing by those skilled in the art that many substitutions, alterations and changes may be made to the disclosed structures and methods without departing from the spirit or scope of the invention.

What is claimed as new and desired to be secured by Letters Patent of the United States is:

1. A method for regulating the working fluid flowrate in a vapor compression cycle device which comprises compressing a working fluid vapor in a compressor, condensing working fluid vapor in a condensing heat exchanger, passing a portion of the working fluid from said condensing heat exchanger through a first expansion device positioned so as to pass working fluid from the lower most section or termination of the output of said condensing heat exchanger, passing a portion of the working fluid from said condensing heat exchanger through a second expansion device positioned so as to pass working fluid from a region of the condensing heat exchanger output which is upstream or higher than the inlet to said first expansion device, said working fluid flowing in said expansion devices being substantially in heat exchange relationship such that the working fluid flowing through said first expansion device can be cooled by the expanded working fluid flowing through said second expansion device, passing the working fluid from said expansion devices to an evaporating heat exchanger or to an evaporating heat exchanger and associated inlet tube of said compressor, evaporating the working fluid in said evaporative heat exchanger, and finally compressing the working fluid vapor for recirculation.

2. A method of regulating the working fluid flowrate of a vapor compression cycle device as in claims 1 wherein the working fluid is a multicomponent working fluid mixture.

3. A method of regulating the working fluid flowrate of a vapor compression cycle device as in claims 1 wherein the working fluid is a dichlorodifluoromethane or monochlorodifluoromethane.

4. A method of regulating the working fluid flowrate of a vapor compression cycle device as in claims 1 wherein said vapor compression cycle device incorporates means for capacity modulation.

5. A vapor compression cycle device comprising a closed working fluid circuit, a working fluid in the circuit, said closed circuit comprising a compressor, a condenser, a first expansion device having an inlet at the termination or lower most portion of the outlet from said condenser, an evaporator connected to the outlet of said first expansion device, the outlet of said evaporator connected to said compressor, a second expansion device, having an inlet positioned upstream from said inlet of said first expansion device and an outlet connected intermediate the inlet of said evaporator and said compressor, and means to transfer heat from the working fluid liquid flowing through said first expansion device to the expanded working fluid flowing through said second expansion device.

6. A vapor compression cycle device as in claim 5 wherein the working fluid is dichlorodifluoromethane or monochlorodifluoromethane.

7. A vapor compression cycle device as in claim 5 wherein the working fluid is a multicomponent working fluid mixture.

8. A vapor compression cycle device as in claim 7 wherein the mixture is a multicomponent fluorocarbon working fluid.

9. A vapor compression cycle device as in claim 5 also comprising means for capacity modulation.

* * * * *